United States Patent [19]

Wilkie

[11] 4,408,446

[45] * Oct. 11, 1983

[54] SINGLES CARPET YARN

[75] Inventor: Arnold E. Wilkie, Pensacola Beach, Fla.

[73] Assignee: Monsanto Company, St. Louis, Mo.

[ * ] Notice: The portion of the term of this patent subsequent to Sep. 22, 1998 has been disclaimed.

[21] Appl. No.: 303,655

[22] Filed: Sep. 18, 1981

Related U.S. Application Data

[63] Continuation-in-part of Ser. No. 71,460, Aug. 3, 1979, Pat. No. 4,290,378.

[51] Int. Cl.[3] ..... D02J 1/08; D02G 3/26

[52] U.S. Cl. ..... 57/246; 28/220; 57/289; 57/350; 57/351; 57/908; 112/410

[58] Field of Search ..... 57/58, 59, 243, 246, 57/247, 282, 289, 290, 350, 351, 908, 206; 28/220, 247, 271–276; 112/410

[56] References Cited

U.S. PATENT DOCUMENTS

| | | | |
|---|---|---|---|
| 2,961,010 | 11/1960 | Berry | 57/206 X |
| 2,985,995 | 5/1961 | Bunting et al. | 57/908 X |
| 3,069,836 | 12/1962 | Dalhstrom et al. | 57/908 X |
| 3,457,610 | 6/1969 | Williams et al. | 57/908 X |
| 3,483,691 | 12/1969 | Williams et al. | 57/908 X |
| 3,537,248 | 11/1970 | Berg et al. | 57/908 X |
| 3,745,617 | 7/1973 | Smith | 28/220 X |
| 3,968,638 | 7/1976 | Morton et al. | 57/247 |
| 4,207,730 | 6/1980 | Lorenz | 57/351 |

*Primary Examiner*—Donald Watkins
*Attorney, Agent, or Firm*—John W. Whisler

[57] ABSTRACT

A bulky, heatset, tangled, twisted singles carpet yarn is provided having exceptional column strength and resistance to bending and untwisting. Cut pile produced therefrom has excellent tuft rigidity and endpoint definition. The yarn is produced by passing a bulked, twisted singles yarn through a chamber wherein the yarn is tangled and heatset with a heated fluid such as steam.

26 Claims, 1 Drawing Figure

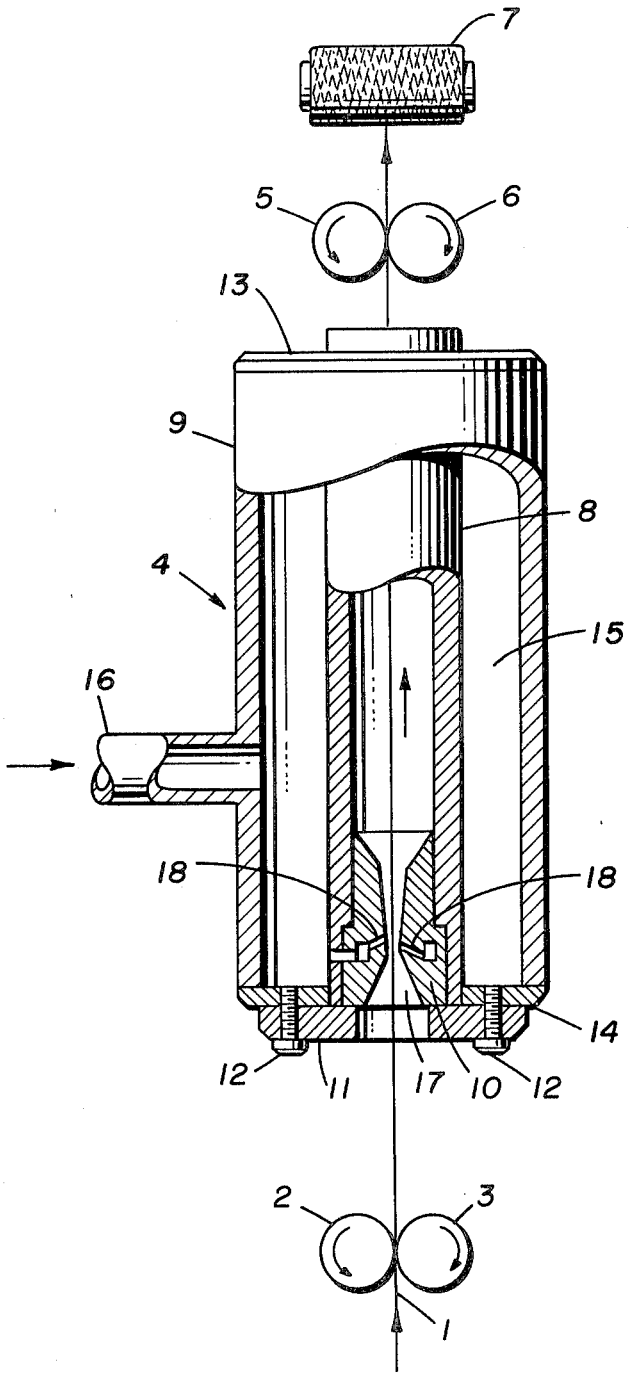
7
5
6
13
9
8
4
15
16
18
18
14
12
11
17
10
12
2
3
1

SINGLES CARPET YARN

CROSS-REFERENCE TO RELATED APPLICATIONS

This application is a continuation-in-part of copending application Ser. No. 71,460, filed Aug. 3, 1979, now U.S. Pat. No. 4,290,378.

BACKGROUND OF THE INVENTION

A. Field of the Invention

This invention relates to novel singles carpet yarn and its production, and is more particularly concerned with improved singles yarn for use as pile in pile fabrics, especially cut pile carpets.

B. Description of the Prior Art

Over 500 million square yards or 418 million square meters of cut pile carpeting are now being produced annually most of which is produced from nylon. With present technology to achieve cut pile with acceptable aesthetics requires a torque balanced two-ply heatset yarn. However, it would be highly desirable to use a twisted heatset singles yarn since it is usually less expensive to produce a large denier singles yarn rather than the two yarns required to form a plied yarn of the same denier. Also, it is cheaper to twist a singles yarn than to form a plied yarn. Additionally, to have both singles and plied yarn would offer fabric designers more flexibility. Unfortunately, unless a singles yarn is highly twisted, cut pile prepared therefrom lacks tuft rigidity (i.e. the tufts lack bending resistance and column strength) and consequently will not stand up. Also, the cut pile lacks end point definition because the tufts tend to expand, balloon and untwist until they become snarled with neighboring tufts, giving the pile a matted appearance wherein the individual tufts become undistinguishable. On the other hand, highly twisted singles yarns are torque lively thereby causing difficulties in commercial carpet heatsetting processes. Moreover, the torque liveliness of the highly twisted singles yarn is not removed by commercial heatsetting processes and, therefore, the yarn must be processed at high tensions to avoid kinks which would obstruct delivery tubes and needles of tufting machines. And, even if the highly twisted, torque lively, singles yarn were processed into cut pile, the resulting tufts would tend to be nonuniform, lack bulk, untwist and generally provide a cut pile having poor aesthetics.

U.S. Pat. No. 3,968,638 describes a singles yarn for cut pile consisting of a highly entangled, singles yarn to which latent crimp and false twist have been imparted. The latent crimp and twist are developed by heat and moisture after tufting such as in the dyeing or finishing operations. However, cut pile produced from this yarn lacks desired aesthetic characteristics of plied heatset yarn, and therefore, has not enjoyed commercial success.

Presently, singles carpet yarns are used to produced level loop pile for commercial applications where durability and low cost rather than aesthetics are of primary importance. Singles yarn used in level loop pile is not twisted and therefore is also not heatset, thereby saving the cost of these yarn processing operations. However, for some commercial carpeting applications, such as libraries, offices, etc., it would be highly desirable to provide an attractive cut pile at a price competitive with level loop pile carpeting.

SUMMARY OF THE INVENTION

According to one aspect of the invention, there is provided a bulky, loopy, heatset, tangled, twisted singles carpet yarn. The yarn is characterized in that the tangle is imparted to the yarn after the twist is inserted and, preferably, as the twist is being heatset in the yarn. The yarn is further characterized in having a bundle twist of 0.50 to 8 turns per inch, preferably, 1 to 6 turns per inch and a lateral coherency ranging from 0.25 to less than 1 cm, when tested as hereinafter defined.

The singles yarn of this invention has exceptional column strength and resistance to bending and untwisting and provides cut pile having exceptional tuft rigidity, end point definition, compression resistance, resilience and wear resistance. The tufts stand up like "soldiers on parade" and when viewed from above the cut pile has the appearance of a "room full of BB's", qualities heretofore obtainable only with cut pile produced from two ply heatset yarn. In comparison, singles yarn processed using conventional mill technology (i.e. cablers or twisters and batch autoclave or continuous heatsetting equipment) lacks column strength and bending resistance and cut pile produced therefrom tends to lie down, balloon and untwist, and in general, has poor end point definition.

The singles yarn of the present invention differs from heretofor produced singles yarn in that it is tangled after being twisted, for example, while being heatset. The tangle in the yarn locks the twist in the yarn (i.e. imparts "twist-lock" thereto) and significantly reduces the tendency of the yarn to untwist, balloon and expand in cut pile and thereby imparts exceptional end point definition to cut pile produced from the yarn. The tangle in the yarn also serves to cross-brace the yarn so that the tufts of cut pile produced therefrom stand up and have exceptional bending resistances, compression resistance, and tuft rigidity (i.e. column strength).

According to another aspect of the invention there is provided a novel heatsetting process (referred to herein as "jet-set" process) for producing the singles yarn of this invention wherein a feed yarn having latent and/or extent bulk and to which has been imparted a bundle twist of 0.5 to 6 tpi is continuously fed at an overfeed of 5% to 50% through an open-ended chamber, such as a tube, having at or near its yarn inlet end at least one jet of heated fluid (preferably steam) which impinges against the yarn whereby fibers on the outside of the twisted bundle are entangled with fibers on the inside of the twisted bundle throughout the length of the yarn. The term "fiber" as used herein includes both filaments and cut lengths from filaments (i.e. staple). Preferably, the yarn in passing through the chamber is under a slight tension sufficient to facilitate handling of the yarn. The tension is easily controlled by adjusting the velocity of the jet of heated fluid and/or overfeed. The entangled fibers serve structurally to cross-brace the yarn, in that, the resulting entanglements tend to traverse the long axis of the yarn. In passing through the chamber the yarn is in intimate contact with high velocity heated fluid for a period of time sufficient to achieve desired setting of the twist in the yarn. Under such conditions latent bulk, if present, will also be developed. The chamber passage is filled with and may also be jacketed by heated fluid. The yarn upon exiting the chamber is ready for tufting. Normally, surface loops are created by the jet action. These loops are believed to contribute to the tuft rigidity of cut pile produced therefrom since they contact neighboring tufts and tend to increase tuft density or packing of the tufts.

Bulk (e.g. crimp) may be imparted to the feed yarn by any suitable means such as by processes described and/or employed in the art such as by hot-jet crimping, stuffer-box crimping, gear-crimping, etc. or by use of appropriate bicomponent filaments or by spinning techniques. A particularly useful process is the draw-texture process described in U.S. Pat. No. 3,457,610 in which continuous filament yarn is drawn and bulked. Normally, the yarn producer imparts a slight twist and/or tangle to bulked continuous filament (BCF) yarn to give it coherency during subsequent processing. Twist is then imparted to the BCF yarn and may be accomplished using conventional twisting equipment such as a cabler or ring twister. The continuous filament yarn after being bulked but before being twisted will usually have a latent or potential bulk of between 10 and 50% when tested as hereinafter described.

The feed yarn may be composed of either staple fibers of continuous filaments of polymeric materials which are capable of being heatset such as polyamides, polyesters, polyolefins and acrylonitrile polymers and will normally have a denier (cotton count) between 500 and 8000 (10.6 and 0.66 with a denier per filament (staple fiber) between 6 and 40. Of course, the feed yarn may be of a higher or lower denier (cotton count) or dpf, if desired. Suitable polymeric materials include nylon 6, nylon 66, polyesters, such as polyethylene terephthalate, acrylics and the like which are thermo-plastic at least in their crimping and twisting behavior. The term acrylic means a fiber-forming, long chain, synthetic polymer composed of at least 85% by weight of acrylonitrile units, $$-CH_2\underset{\underset{CN}{|}}{CH}-,$$

in the polymer chain and includes copolymers of acrylonitrile and one or more suitable monoethylenically unsaturated monomers copolymerizable with acrylonitrile, such as, vinyl acetate, methyl methacrylate, methylvinylpyridine, vinylchloride, and vinylidene chloride.

While the yarns of the present invention are particularly useful for providing cut pile carpet constructions, they may be used for providing loop pile carpet constructions or in providing other pile fabrics or textile fabrics.

The jet-set process used to provide the singles yarn of the invention offers several significant processing advantages over present carpet mill heatsetting technology, i.e. conventional batch autoclave and continuous heatsetting technology. In the first place, the heatsetting apparatus of the jet-set process typically occupies a space of only about 0.03 $ft^3$ ($8.4\times10^{-4}$ $M^3$), whereas that of the batch autoclave process typically occupies about 422.5 $ft^3$ (11.8 $M^3$) and that of the continuous process about 4920 $ft^3$ (137.8 $M^3$). Secondly, the conventional processes are more labor intensified than the jet-set process. Thirdly, the initial cost of the jet-set heatsetting equipment is less than that of the conventional heatsetting equipment.

In addition to processing advantages, the jet-set process also offers important product advantages over the conventional processes, the most important of which, is that, the jet-set process provides yarn from which pile having significantly better dye uniformity (i.e. dyed to a uniform shade of color without streaks) is obtained. Dye non-uniformity is cut pile normally results from there being variations in the pile yarn, particularly, variations in bulk, modification ratio of the filament cross-section, endpoint definition and thermal history. As a practical matter, it is not possible in texturing operations to provide a plurality of yarns each having the same level of crimp, that is, there are variations in crimp from one texturing position to the next and from machine to machine. In conventional heatsetting operations where the yarns are processed under conditions of zero tension, these crimp variations result in variations in bulk from yarn to yarn. In the jet-set process, however, the yarns are processed under conditions of controlled tension so that each yarn will bulk to substantially the same level. The tension is conveniently controlled by controlling the overfeed. As bulk is developed in the yarn, the yarn contracts and the amount of this contraction is limited by the overfeed, that is, when the yarn no longer can contract, no further significant bulk is developed. Also, in the jet-set process modification ratio (MR) variations are minimized since the tangle interrupts fiber parallelism. Further, cut pile tufts produced from jet-set yarn impart better endpoint definition than cut pile produced from corresponding yarn heatset by conventional processes and, thereby, are most resistant to untwisting and flaring which cause non-uniformity in color appearance; the flared tuft ends where dyed appear to be of a darker shade than ends which have not flared. Finally, the thermal history of each end is substantially the same in the jet-set process, whereas in the conventional processes the yarn, even though processed at the same time, have different thermal histories due to temperature variations within the various heatsetting chambers. Additionally, yarn heatset by conventional heatsetting processes is exposed to high temperatures for relatively long periods of time which can subsequently cause dye uniformity difficulties. For example, the exposure time in the batch autoclave process is 20 to 30 minutes and in some continuous processes in excess of 3 minutes as compared to only a fraction of a second in the jet-set process. Also, in the conventional processes the yarn is merely setting in an atmosphere of steam, whereas in the jet-set process the yarn is in intimate contact with high velocity steam which permits the steam to penetrate the yarn.

According to yet another aspect of the invention, there is provided a pile fabric and, in particular, a cut pile carpet, the tufts of which are formed of the singles yarn of the invention.

According to still another aspect of the invention, there is provided a continuous process for in-line twisting and heatsetting of singles feed yarn of the type described hereinbefore. The small geometry of the jet-set heatsetting apparatus and the continuous nature of the jet-set process permit the apparatus to be coupled in-line with 2 for 1 twisting equipment and/or other processing equipment. Normally, yarn is processed through a 2 for 1 twister at take-off speeds of up to 125 yards (114.3 m) per minute. According to this aspect of the invention the yarn is preferably continuously withdrawn from the 2 for 1 twister at a yarn speed ranging from 50 to 125 ypm and fed directly through the jet-set apparatus. The distance between the twister and jet-set apparatus is not important and may be selected to accommodate available space. There are many obvious advantages to this aspect of the invention, such as, both operations now require very little space and time since the heatsetting operation can be operated in-line at the same yarn speed as the twisting operation. Additionally, only one operator is required for the in-line operation.

BRIEF DESCRIPTION OF THE DRAWING

The FIGURE is a schematic of an apparatus arrangement suitable for use in preparing the singles yarn of this invention.

DETAILED DESCRIPTION OF THE INVENTION

In a preferred embodiment of the invention disclosed in the FIGURE, feed yarn 1, having twist and latent bulk, is fed from a suitable source (not shown), such as from a cabler, two-for-one twister or package, between driven roll 2 and its associated idler cot roll 3, through device 4, between driven roll 5 and its associated idler cot roll 6 and, finally wound on to a take-up roll to form package 7. Roll 2 is driven at a higher peripheral speed than roll 5 so as to provide a 5% to 50% overfeed.

Device 4 comprises an inner tubular member 8, an outer tubular member 9 and a replaceable jet nozzle 10 sealably positioned within member 8 at the yarn inlet end of device 4 by means of follower ring 11 held by cap screws 12. Members 8 and 9 are connected at the yarn inlet end and yarn outlet and by shoulders 14 and 13, respectively, thereby defining annular space 15 which jackets tubular member 8. A heated fluid under pressure is supplied to annual space 15 via conduit 16. Jet nozzle 10 has a bore 17 through which yarn 1 passes and which has three sections, a converging frusto-conical inlet section, a diverging frusto-conical outlet section, and a diverging frusto-conical middle section that joins said inlet and outlet sections. Preferably, at least two ports 18 are spaced apart along the axis of the jet nozzle and spaced circumferentially about the axis connect space 15 and middle bore section. Each port 18 and the middle bore section define an acute angle. Normally, this angle will be between 5° C. and 80° C.

Yarn 1 passes through device 4 via follower ring 11, bore 17 and, finally, into and through member 8. Superheated steam (or other heated fluid) passes from space 15 through ports 18 and impinges laterally against yarn 1 within bore 17 at an angle sufficient to forward the yarn into device 4 and at a velocity sufficient to achieve a desired level of tangle. During processing of the yarn bore 17 is filled with steam and tubular member 8 is filled with and jacketed by steam, thereby providing within tubular member 8 an environment in which the twist is capable of being set in the yarn and latent bulk developed. For a given set of processing conditions (e.g. heated fluid selection, heated fluid pressure and temperature, yarn speed, denier of yarn, etc.), tubular member 8 must be of a length sufficient to allow adequate time for significant twist setting and bulk development to occur. Normally, with yarn inlet speeds of up to 100 mpm a tubular member length between 10 and 50 cm is more than sufficient to allow adequate time to set the twist in the yarn. It has been found that making tubular member 8 longer than necessary has little effect. Of course, speeds in excess of 100 mpm may suitably be used by selecting appropriate processing conditions.

Processing conditions or factors which have some influence on the tangle level imparted to the yarn are: velocity at which the jet of steam impinges against the yarn, temperature of the steam, yarn speed, total denier and denier per filament of the yarn, composition of the yarn, modification ratio of the yarn, bulk of the yarn, shrinkage of the yarn, finish applied to the yarn and overfeed. Normally, except for the velocity of the steam and overfeed, the other conditions or factors are fixed for a given process. In general, it is desirable to operate the process at an overfeed which is as high as practical, that is, as high as possible while still maintaining continuous and smooth processing of the yarn. The tangle level can then be adjusted by adjusting the steam pressure which in turn changes the velocity of the steam. Several adjustments of the overfeed and steam velocity may be required to attain the desired tangle level and highest practical overfeed. While it is preferred to use steam as the heated fluid, heated air or some other heated fluid such as heated nitrogen or carbon dioxide may be used.

It will be appreciated that, if desired, the entire embodiment shown in the FIGURE could be inverted so that the yarn would be traveling in a downward instead of upward direction.

Devices particularly useful in carrying out the jet-set process of this invention are described, although not for the purpose of heatsetting, in U.S. Pat. No. 3,457,610 and U.S. Pat. No. 3,745,617. The jet nozzles described in these patents may be replaced with other suitable nozzles. A particularly preferred nozzle for use with the invention is that described in U.S. Pat. No. 3,609,834. Accordingly, the disclosures of the three above-mentioned patents are incorporated herein by reference.

TESTS

(a) Bulk and Thermal Shrinkage

Shrinkage and bulk as used herein is determined by the following test: A sample of yarn is placed under sufficient tension to fully extend the yarn (straighten out any crimp) without stretching or elongating the filaments. The length of the yarn in this condition is measured and recorded as $L_1$. The yarn is then subjected to 180° C. dry heat for five minutes and cooled for 60 seconds under no tension, and then after having been cooled for an additional 30 seconds while under a tension of 0.009 grams per denier its length is measured while under this tension (0.009 gpd). This latter measured length is recorded as $L_2$. Then, the yarn is placed under a tension of 0.8 grams per denier and its length is again measured while under this latter tension. This measured length is recorded as $L_3$. The % bulk and % thermal shrinkage are then determined by the following formulas: % Bulk$=(L_1-L_2/L_1)\times 100$ and % Thermal Shrinkage$=(L_1-L_3/L_1)\times 100$.

(b) Laterial Coherency

The term "lateral coherency" as used herein is determined by the following test: A 20-inch (50.8 cm) sample of yarn, if twisted, is manually untwisted. Then, the sample is horizontally positioned between two clamps, one fixed and the other free to move toward the fixed clamp. The yarn is under a slight tension (about 1 gram) to remove slack. Two hooks, each weighing approximately one gram, are then placed equidistant from the clamps and in about the center of the yarn bundle to separate the bundle into two equal groups of fibers or filaments. One hook is fixed and a 500-gram weight is attached to the other hook. When the weight is attached to the hook, the two groups of fibers or filaments are pulled apart. As the hook with the 500-gram weight moves away from the fixed hook, the movable clamp moves toward the fixed clamp in the horizontal direction. When the weight comes to rest, the distance between the hooks in centimeters is measured. The average of twelve determinations is taken as the lateral coherency. If the yarn is completely pulled apart by the test the lateral coherency is infinity (∞). The smaller the lateral coherency valve, the more coherent the yarn.

(c) Thermal Stress Analysis

Thermal stress results are obtained on yarn samples with the Kanebo Thermal Stress Tester (Kanebo Engineering, Ltd., Osaka 534, Japan). in conducting the test, a 23 cm yarn sample in the form of a single strand skein is mounted in the Tester between two vertically positioned hooks. During the test, the yarn temperature is increased from room temperature to 270° C. at the rate of 150° C./min. while the yarn is maintained at constant length. A pretension of 5 mg/denier is exerted on the yarn samples. The tester prints out a force-temperature curve. The curve shows the amount of force in grams required to prevent the yarn sample from shrinking at any given temperature. Heatset yarns provide a generally flat curve in the 100° to 200° C. range indicating little or no shrinkage of the yarn occurs. On the other hand, yarns which have not been heatset would provide a curve with a considerably greater slope in the 100° to 200° C. range indicating significantly more shrinkage of these yarns occurs in the 100° to 200° C. range.

The following examples are given to further illustrate the invention. In the examples an apparatus arrangement substantially as shown in the FIGURE was used. Device 4 had an outer tubular member 9 comprised of standard 2.5 inch (6.3 cm) pipe and an inner tubular member 8 comprised of standard 1.5 inch (3.8 cm) pipe having an inside diameter of 0.75 inches (1.9 cm). Member 8 projected 0.5 inch (1.27 cm) beyond the outer end of member 9. The overall outside diameter of jet nozzle 10 was 0.75 inch and the overall length was 1.327 inch (3.37 cm). The nozzle contained 3 removable waffers as shown in FIG. 5 of U.S. Pat. No. 3,609,834. The converging inlet section of the nozzle bore had a 50° cone angle and converged to a bore diameter of 0.078 inch (2 mm). The middle bore section then diverged at a 15° cone angle and joined the diverging outlet having a 90° cone angle. The center waffer had one slot and the top waffer two slots (conduits) each drilled through the wall of the bore at an angle of 140° with respect to the axis of the bore. The slots in the top waffer were spaced 0.050 inch (1.3 mm) on center and the slot in the center waffer was spaced opposite and equidistant from the slots in the top waffer. The slots in the top waffer each had a depth of 0.040 inch (1.02 mm) and a width of 0.012 inch (0.30 mm). The slot in the center waffer had a depth of 0.030 inch (0.76 mm) and a width of 0.020 inch (0.51 mm). The nozzle was locked into the body assembly as shown in the FIGURE.

EXAMPLE

Three singles feed yarns were heatset using the apparatus shown in the FIGURE and under the conditions specified in the table below. The conditions were varied from sample to sample. Superheated steam was used as the heated fluid. A total of nine samples were collected and tested. One feed yarn was a 1.5 cotton count (1.5 cc/1) staple yarn (samples 1–4 in the table) having a bundle twist of 4.5 turns per inch of twist in the Z direction and being composed of staple fibers each having a denier of 15. The other two feed yarns were bulked continuous filament (BCF) yarns each having a total denier of 3640 and a denier per filament of 10. One of the BCF yarns (samples 5–8 in the table) had a bundle twist of 4.5 turns per inch of twist in the Z direction and the other BCF yarn (sample 9 in the table) had a bundle twist of 4.0 turns per inch of twist in the Z direction. Each of the feed yarns was composed of polyhexamethylene adipamide (nylon 66) fibers.

| | SAMPLE | | | | | | | | |
|---|---|---|---|---|---|---|---|---|---|
| | 1 | 2 | 3 | 4 | 5 | 6 | 7 | 8 | 9 |
| BCF | no | → | → | → | yes | → | → | → | → |
| Staple | yes | → | → | → | no | → | → | → | → |
| Twist, tpi Z | 4.5 | → | → | → | → | → | → | → | 4.0 |
| Steam PSIG | 100 | 150 | 200 | → | 100 | 150 | 200 | → | → |
| °C. | 230 | → | → | 260 | 230 | → | → | 260 | → |
| Lower feed roll speed, ft/min | 150 | → | → | → | → | → | → | → | 185 |
| Upper feed roll speed, ft/min | 124 | 109 | → | → | 100 | 92 | → | → | → |
| Overfeed, % | 17.3 | 27.3 | → | → | 33.3 | 38.7 | → | → | 50.3 |
| Lateral Coherency, cm | 3.25 | 1.12 | 0.93 | 0.65 | 4.27 | 3.02 | 1.53 | 1.46 | 0.80 |
| Total Denier | 3915 | 4310 | → | 4320 | 4795 | 5326 | 5520 | 5640 | 6125 |
| % Bulk | 7.7 | 8.6 | 8.1 | 7.2 | 11.3 | 11.8 | 11.3 | 7.7 | 15.8 |
| % Thermal Shrinkage | 0 | → | −0.1 | → | −0.2 | → | −0.1 | 0 | −0.1 |

Each of the yarn samples had exceptional column strength and resistance to untwisting and bending, particularly those having low lateral coherency values, i.e., samples 3, 4 and 9. Thermal stress analysis of the treated yarn samples showed the yarn samples to be heatset, that is, have generally flat force-temperature curves in the 100°–200° C. range. The feed yarns (untreated yarns) provided curves of considerably greater slope in this range.

Yarns corresponding to the yarns illustrated in the Table when tufted to make cut pile carpeting will provide a carpet having excellent tuft rigidity, end point definition, resilience and compression resistance as well as good body, cover and wear-resistant qualities.

I claim:

1. A bulky, heatset, singles carpet yarn, said yarn having a bundle twist of 0.5 to 8.0 turns per inch (19.7 to 236.2 turns per meter) and sufficient tangle to provide a lateral coherency ranging from 0.25 to less than 1.0 cm, wherein said tangle has been imparted to the yarn after said bundle twist.

2. The yarn of claim 1 wherein the bundle twist is at least 1.0 turns per inch (39.37 turns per meter).

3. The yarn of claim 2 wherein said bundle twist is at least 2.0 turns per inch (78.74 turns per meter).

4. The yarn of claim 2 wherein the yarn is composed of continuous filaments.

5. The yarn of claim 4 having a total denier ranging from 500 to 8000 and a denier per filament ranging from 6 to 40.

6. The yarn of claim 2 wherein the yarn is composed of staple length fibers.

7. The yarn of claim 6 having a cotton count ranging from 10.6 to 0.66 and a denier per staple fiber ranging from 6 to 40.

8. The yarn of claim 1 wherein the yarn is composed of polyhexamethylene adipamide.

9. A carpet or rug having a cut pile formed by tufts anchored in a backing, each tuft being formed from a bulky, heatset, tangled, twisted singles yarn having a bundle twist of 0.5 to 6.0 turns per inch (19.7 to 236.2 turns per meter) and a lateral coherency ranging from 0.25 to less than 1 cm, wherein the tangle has been imparted to the yarn after the twist.

10. The carpet or rug of claim 9 wherein the yarn has a bundle twist of at least 1.0 turn per inch (39.37 turns per meter).

11. The carpet or rug of claim 9 wherein said bundle twist is at least 2.0 turns per inch (78.74 turns per meter).

12. The carpet or rug of claim 9 wherein the yarn is composed of continuous filaments.

13. The carpet or rug of claim 12 wherein the yarn has a total denier ranging from 500 to 8000 and a denier per filament ranging from 6 to 40.

14. The carpet or rug of claim 9 wherein the yarn is composed of staple length fibers.

15. The carpet or rug of claim 14 wherein the yarn has a cotton count ranging from 10.6 to 0.66 and a denier per staple fiber ranging from 6 to 40.

16. The carpet or rug of claim 9 wherein the yarn is composed of polyhexamethylene adipamide.

17. A process for heatsetting a bulked, twisted singles carpet yarn having a bundle twist between 0.5 and 6.0 turns per inch (19.7 to 236.2 turns per meter), comprising: passing said singles yarn under tension at an overfeed of from 5% to 50% through an open-ended tubular chamber filled with a heat fluid, wherein at least one jet of heated fluid is directed laterally against the yarn at a velocity sufficient to cause filaments or fibers at the outside of the bundle to entangle with those at the inside of the bundle along the entire length of the yarn, said process being characterized in that the temperature of the heated fluid and the residence time of the yarn in the chamber are correlated to set the twist in the yarn and the overfeed and velocity of said heated fluid are correlated to provide a yarn having a lateral coherency ranging from 0.25 to less than 1 cm.

18. The process of claim 17 wherein the heated fluid is superheated steam.

19. The process of claim 17 wherein the yarn has a bundle twist of at least 1.0 turn per inch (39.37 turns per meter).

20. The process of claim 17 wherein the yarn has a bundle twist of at least 2.0 turns per inch (78.74 turns per meter).

21. The process of claim 17 wherein the yarn is a continuous filament yarn.

22. The process of claim 21 wherein the yarn has a total denier ranging from 500 to 8000 and a denier per filament ranging from 6 to 40.

23. The process of claim 17 wherein the yarn is composed of staple length fibers.

24. The process of claim 23 wherein the yarn has a cotton count ranging from 10.6 to 0.66 and a denier per staple fiber ranging from 6 to 40.

25. The process of claim 17 wherein the yarn is composed of polyhexamethylene adipamide.

26. The process of claim 17 wherein three jets of heated fluid are directed against the yarn.

* * * * *